United States Patent [19]

Cook et al.

[11] Patent Number: 4,973,804

[45] Date of Patent: Nov. 27, 1990

[54] LOW PROFILE INERTIA SWITCH

[75] Inventors: John E. Cook; Kerry Drew, both of Chatham, Canada

[73] Assignee: Siemens Automotive Limited, Chatham, Canada

[21] Appl. No.: 482,715

[22] Filed: Feb. 26, 1990

[51] Int. Cl.[5] ..... H01H 35/14; H01H 35/40

[52] U.S. Cl. ..... 200/61.48; 200/61.49; 200/61.51; 200/83 B; 200/83 N; 200/83 W

[58] Field of Search ..... 200/61.45 R, 61.45 M, 200/61.48–61.53, 83 A, 83 B, 83 N, 83 W; 335/255, 256, 266

[56] References Cited

U.S. PATENT DOCUMENTS

| | | | |
|---|---|---|---|
| 3,097,272 | 7/1963 | Hautly | 200/61.49 |
| 3,911,393 | 10/1975 | Biggs | 200/83 N X |
| 4,093,836 | 6/1978 | Euy et al. | 200/61.53 |
| 4,827,091 | 5/1989 | Behr | 200/61.53 X |
| 4,902,861 | 2/1990 | Cook | 200/61.48 |

*Primary Examiner*—J. R. Scott

*Attorney, Agent, or Firm*—George L. Boller; Russel C. Wells

[57] ABSTRACT

A diaphragm-type inertia switch for sensing deceleration places the inertial mass in the chamber that contains the contacts. The other chamber has a thin concave-convex shape that gives the switch a low profile. The switch has a molded plastic base containing a test coil for attracting the inertial mass to test the switch. A mechanism for calibrating the switch is also included.

9 Claims, 3 Drawing Sheets

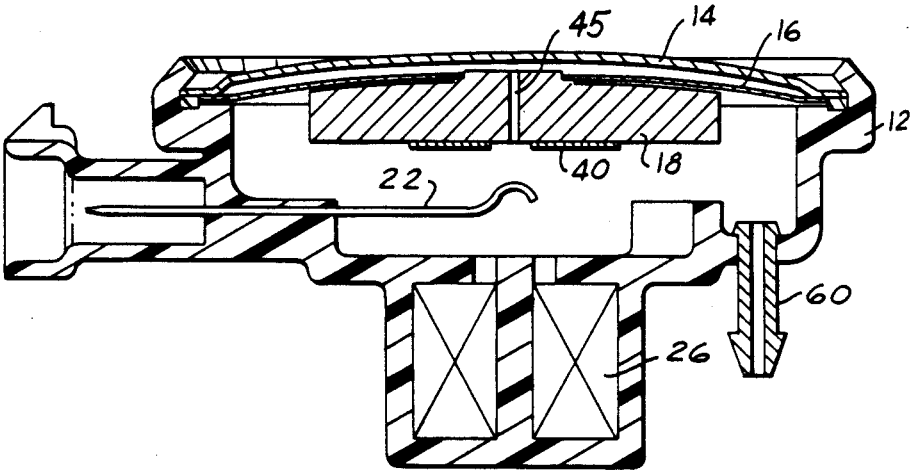
FIG. 4
FIG. 5
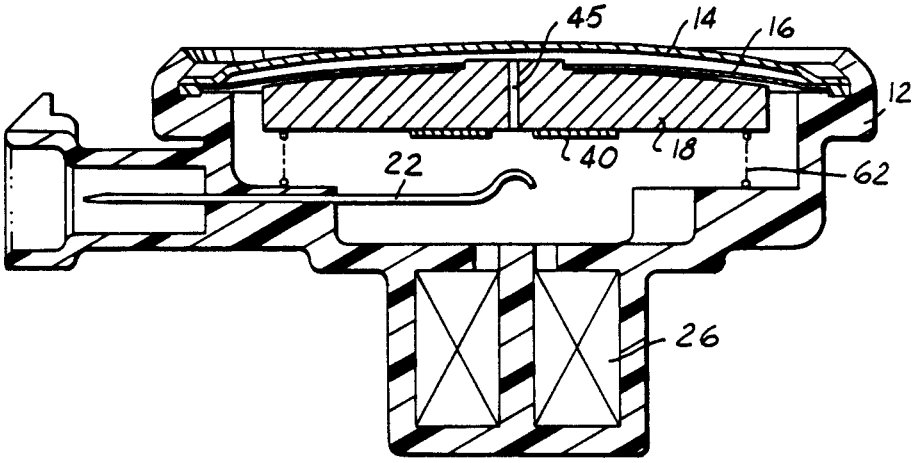

LOW PROFILE INERTIA SWITCH

REFERENCE TO A RELATED APPLICATION

In certain respects, this application is for an invention that is an improvement on that of commonly-owned U.S. Pat. No. 4,902,861 issued Feb. 20, 1990.

FIELD OF THE INVENTION

This invention relates to an inertia switch of the type that is used to detect certain deceleration of an automotive vehicle for the purpose of supplying a signal to the deployment system for a supplemental inflatable restraint for a vehicle occupant.

BACKGROUND AND SUMMARY OF THE INVENTION

Briefly, the inertia switch of U.S. Pat. No. 4,902,861 comprises a diaphragm that divides a casing into two chambers, electrical terminals in one of the chambers, a mass that is disposed in the other chamber and affixed to the diaphragm, and an electrical contact movable with the diaphragm for bridging the electrical terminals to provide a switch signal when the switch is subjected to a certain deceleration characteristic along the switch axis. The switch signal is supplied to the deployment system for a supplemental inflatable restraint for an occupant. The predetermined deceleration characteristic to which the switch responds is a function of the diaphragm characteristics, the mass, and the size of a control orifice which communicates the two chambers. The control orifice functions to impart dampening to the diaphragm motion because as the diaphragm moves, gas is forced between the two chambers through the control orifice and the one chamber.

One improvement that is afforded by the present invention is that such a switch is endowed with a low profile, thereby making it more compact, yet without detracting from functional and calibration capabilities. Another improvement is that an electromagnetic coil for performing a testing function can be incorporated into the inertia switch in an efficient manner. A still further improvement is that means can be incorporated to provide for the switched vacuum testing of the switch.

Additional features and advantages will suggest themselves to the reader as the description proceeds. A drawing is included and presents a preferred embodiment of the invention according to the best mode contemplated at this time for carrying out the invention.

BRIEF DESCRIPTION OF THE DRAWINGS

FIG. 4 is a cross-sectional view through another embodiment of an inertia switch.

FIG. 5 is a cross-sectional view through a further embodiment of an inertia switch.

DESCRIPTION OF THE PREFERRED EMBODIMENT

Figure 1:
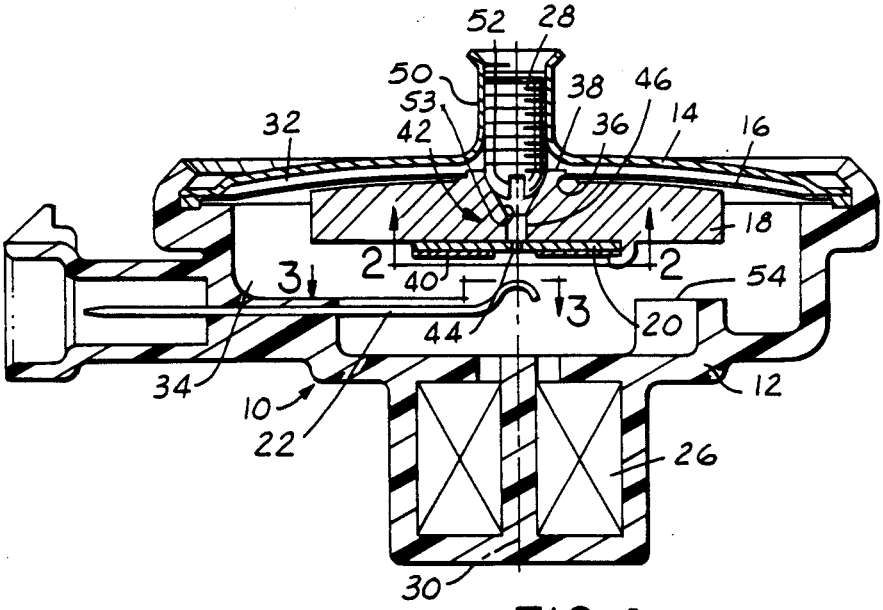
FIG. 1 is a cross-sectional view through an inertia switch embodying principles of the invention.
Figure 2:
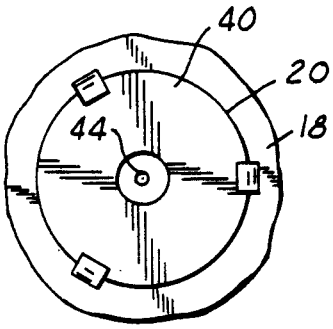
FIG. 2 is a fragmentary view looking in the direction of arrows 2—2 in FIG. 1.
Figure 3:
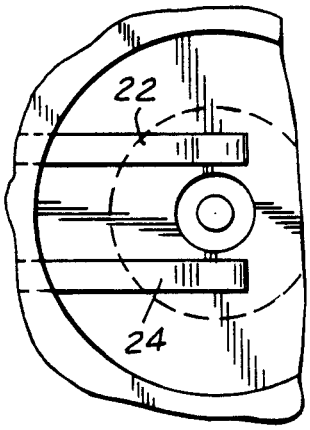
FIG. 3 is a fragmentary view looking in the direction of arrows 3—3 in FIG. 1.

An inertia switch 10 comprises the following parts: a plastic base 12; a metal cover 14; a metal diaphragm 16; a metal mass 18; an electrical contact 20; a pair of electrical terminals 22, 24; an electromagnetic coil 26; and an adjustment screw 28. The axis is designated by the numeral 30.

Base 12 is fabricated by molding plastic material around the body of coil 26 and intermediate portions of terminals 22, 24. Lead wires (not shown) from the body of coil 26 are connected to addition electrical terminals (not shown) so that the coil can be selectively energized from an external source for testing the inertia switch in a manner to be more fully explained in the ensuing description.

Base 12 has a circular opening which is closed by cover 14. The peripheral margins of cover 14 and diaphragm 16 are also circular with the three parts 12, 14, and 16 being shaped such that in assembly the entire margin of diaphragm 16 is captured between cover 14 and base 12 in a sealed manner. This creates two internal chambers 32 and 34 on opposite sides of diaphragm 16.

Diaphragm 16 has a central hole 36 which passes a very short neck 38 of mass 18. The diaphragm and mass are united in a sealed manner so that gas cannot pass between chambers 32 and 34 via the fitting of neck 38 to hole 36. The bulk of mass 18 lies within chamber 34. Diaphragm 16 is inherently biased to have a concave-convex shape that is convex toward chamber 32. Cover 14 has a similar shape that is concave toward chamber 32. Together they cooperatively define a thin concave-convex shape for chamber 32 thereby endowing the inertia switch with a low axial profile.

Mass 18 is securely joined to diaphragm 16 in any suitable manner so that the two form a unit. Likewise, electrical contact 20 is securely affixed to the face of mass 18 that is opposite diaphragm 16 so that the exposed face of the contact is toward terminals 22, 24. It may be desirable for the exposed contact face to contain a thin gold plating 40 for making contact with terminals 22, 24 when the switch is actuated.

The diaphragm, mass, and electrical contact are constructed to have coaxial symmetry about axis 30. Orifice means 42 is provided to establish fluid communication between chamber 32 and 34. Orifice means 42 is coaxial with axis 30 and takes the form of a control orifice 44 through contact 20 and a larger orifice 46 through mass 18. The latter orifice has a circular segment extending from the former and a frusto-conical segment extending from the circular segment. The frusto-conical segment forms a seat for the rounded distal end of calibration screw 28 that is threaded into a central circular sleeve 50 that is formed integrally with cover 14. Because the diaphragm is constructed so as to be inherently biased away from terminals 22, 24 and toward cover 14, theoretical seating contact between screw 48 and the frusto-conical section of orifice 46 would occur on a circular line of contact that is concentric with axis 30. In order to assure fluid communication past what would otherwise be an endless circular line of contact, the distal end of screw 28 contains a diametrical slot 52 such that when the screw is seated, the slot interrupts the circular line of contact between the screw and seat 53. The axial position of screw 28 establishes an axial distance between contact 20 and terminals 22, 24 for calibrating the switch.

The inertia switch operates in the following manner. When subjected to a certain deceleration force characteristic along axis 30, the diaphragm 16, mass 18, and contact 20 will be displaced from the position illustrated in FIG. 1 to a position where contact 20 bridges terminals 22, 24 to create electrical circuit .continuity between them. The requirement that the gas (air, for example) in the sealed chamber 34 pass through the control orifice as the volume of chamber 34 contracts, imparts damping to the motion. The switch therefore gives a switch signal via terminals 22, 24. Base 12 includes a stop 54 that limits the overtravel so that excessive flexing of terminals 22, 24 is avoided.

Mass 18 is a ferromagnetic material so that it, along with the diaphragm 16 and contact 20, will be displaced to the signal-giving position when coil 26 is suitably energized. This is a useful test feature.

In many respects, the switch of FIG. 4 is similar to that of FIG. 1 and therefore, like reference numerals will be used to designate corresponding parts but a detailed description will be omitted in the interest of conciseness. One difference between the switch of FIG. 4 and that of FIG. 1 is that the switch of FIG. 4 also includes a nipple 60 that provides communication to chamber space 34. With the switch assembly properly installed in a vehicle, one end of a tubular hose (not shown) is fitted over the exposed exterior end of nipple 60. The opposite end of the hose leads to a switched vacuum source. When the switch that controls the communication of the vacuum source to chamber space 34 via nipple 60 is closed, vacuum is not communicated to chamber space 34. However, when it is desired to perform a test of the inertia switch, the vacuum switch is opened to communicate vacuum to chamber space 34. The pressure differential acting across the diaphragm 16 causes the diaphragm to be displaced downwardly from the positions shown in FIG. 4 in a sufficient amount that contacts 22 and 24 are bridged by the conductive layer 40 on mass 18.

The capability for testing the inertia switch via switched vacuum can be additional to the electromagnetic test capability afforded by coil 26 or it can be in substitution of the electromagnetic test capability.

A further difference between the inertia switch of FIG. 4 and that of FIG. 1 is that cover 14 contains no provision for acceptance of screw 28. Proper calibration is attained by means of a diametrically precise control orifice 45 that passes completely through the mass communicating chamber spaces 32 and 34. Such a precise aperture could provide a less costly construction for the inertia switch. Technology exists for creating precision holes and an appropriate form of such technology may be employed.

The embodiment of the inertia switch illustrated in FIG. 5 differs from that of FIG. 4 in that the vacuum test feature provided by nipple 60 is omitted. This embodiment includes a coil spring 62 for biasing the diaphragm 16 in any situation where the diaphragm does not have an inherent bias or else whatever inherent bias it has, is less than desired. The spring 62 is shown to act between mass 18 and an internal shoulder of base 12.

Figure 6:
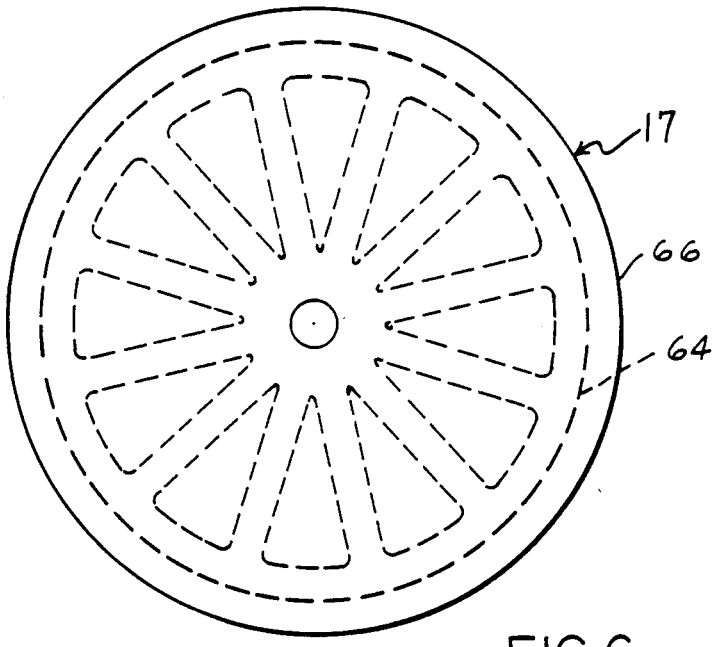
FIG. 6 is a plan view of an alternate form of diaphragm.
Figure 7:
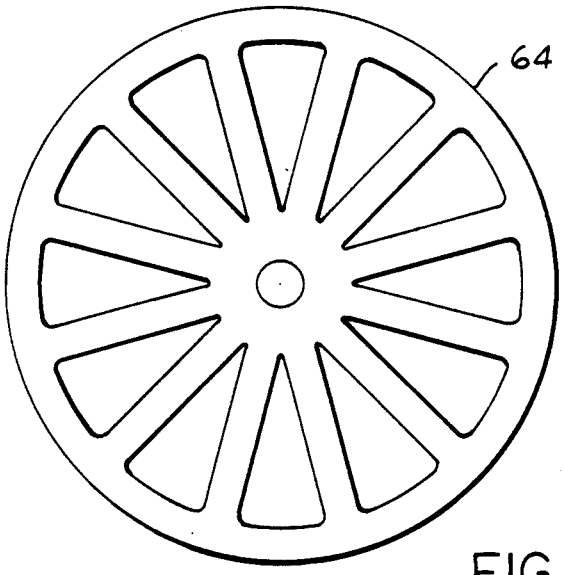
FIG. 7 is a plan view illustrating a component part of the diaphragm of FIG. 6 by itself.

FIGS. 6 and 7 illustrate an alternate embodiment of a diaphragm 17 that comprises a two-part construction. The diaphragm comprises a webbed support member 64 that is either press-fitted or insert-molded with respect to a rubber element 66. Bias for the diaphragm may be obtained either inherently by the diaphragm construction, or alternately by inclusion of a coil spring such as the coil spring 62 of FIG. 5. Where the diaphragm has an inherent bias, such inherent bias may be imparted by the webbed support, the material being steel by way of example.

Switch 10 has thus been shown to operate on the same basic principles as the inertia switch of U.S. Pat. No. 4,902,861, but to contain addition improvements. Those improvements are set forth in the following claims, and it should be understood that the claims are applicable to other equivalent embodiments.

What is claimed is:

1. In an inertia switch structure comprising:

a casing that is divided into two chambers by a axially movable wall structure which comprises a diaphragm, mass and terminal operating means;

said terminal operating means being disposed within one of said two chambers;

electrical terminal means which is disposed in said one chamber in the path of said terminal operating means as said diaphragm moves toward said one chamber and which gives a switch signal when operated by said terminal operating means;

orifice means in said wall structure communicating said two chambers with each other, said orifice means comprising a control orifice;

said inertia switch occupying an off state, when subjected to axial force below a predetermined magnitude and duration characteristic in a sense urging said terminal operating means, mass, and diaphragm toward said electrical terminal means, said off state being defined by said terminal operating means being spaced from said terminal means;

said inertia switch assuming an on state, when subjected to axial force in said sense equaling or exceeding said predetermined magnitude and duration characteristic, said on state being defined by said terminal operating means operating said terminal means;

said orifice means functioning to conduct a gas from said one chamber to the other of said chambers in response to displacement of said terminal operating means, mass, and diaphragm toward said terminal means, said control orifice restricting the flow of gas through said orifice means to impart dampening to the motion of said diaphragm, mass, and terminal operating means toward said terminal means;

the improvement which comprises:

said casing being cooperatively defined by a plastic base having a circular open end that is closed by a circular cover;

said diaphragm having a circular peripheral margin;

said cover and said base coacting to capture the entire peripheral margin of said diaphragm;

at least the bulk of said mass being disposed entirely within said one chamber; and said circular cover comprising a wall that is concave toward said other chamber, said diaphragm comprising a wall that is convex toward said other chamber, and said cover and said diaphragm being disposed such that said other chamber is for the most part cooperatively defined by the closely spaced apart nesting of said concave and convex walls to have a thin concave-convex shape when the inertia switch is subjected to no axial force.

2. An inertia switch as set forth in claim 1 in which said terminal operating means comprises an electrical contact that is adapted to make physical contact with said electrical terminal means.

3. An inertia switch as set forth in claim 2 in which said diaphragm is constructed so as to be inherently biased in the axial direction away from said terminal means.

4. An inertia switch as set forth in claim 3 including a stop for engaging at least one of said diaphragm, said mass, and said electrical contact to set a limit for the extent to which said diaphragm is biased away from said terminal means.

5. An inertia switch as set forth in claim 4 in which said stop is adjustably disposed on said cover to engage a portion of said mass that is exposed to the stop via an aperture in said diaphragm, said portion of said mass comprising a seat on which a distal portion of said stop seats, and aperture means in said distal portion of said stop forming a portion of said orifice means when said distal portion of said stop seats on said seat.

6. An inertia switch as set forth in claim 2 including completely embedded in said plastic base, the body of an electromagnetic coil which, when energized, attracts said mass to cause said electrical contact to contact said terminal means for electrical testing of the switch.

7. In an inertia switch structure comprising:

a casing that is divided into two chambers by a axially movable wall structure which comprises a diaphragm, mass and terminal operating means;

said terminal operating means being disposed within one of said two chambers;

electrical terminal means which is disposed in said one chamber in the path of said terminal operating means as said diaphragm moves toward said one chamber and which gives a switch signal when operated by said terminal operating means;

orifice means in said wall structure communicating said two chambers with each other, said orifice means comprising a control orifice;

said inertia switch occupying an off state, when subjected to axial force below a predetermined magnitude and duration characteristic in a sense urging said terminal operating means, mass, and diaphragm toward said electrical terminal means, said off state being defined by said terminal operating means being spaced from said terminal means;

said inertia switch assuming an on state, when subjected to axial force in said sense equaling or exceeding said predetermined magnitude and duration characteristic, said on state being defined by said terminal operating means being placed in contact with said terminal means;

said orifice means functioning to conduct a gas from said one chamber to the other of said chambers in response to displacement of said terminal operating means, mass, and diaphragm toward said terminal means, said control orifice restricting the flow of gas through said orifice means to impart dampening to the motion of said diaphragm, mass, and terminal operating means toward said terminal means;

the improvement which comprises:

said casing being cooperatively defined by a plastic base having an open end that is closed by a cover;

said diaphragm having a peripheral margin;

said cover and said base coacting to capture the entire peripheral margin of said diaphragm;

at least the bulk of said mass being disposed entirely within said one chamber; and completely embedded in said plastic base, the body of an electromagnetic coil which, when energized, exerts an attractive force on said mass to cause said terminal operating means to operate said terminal means for electrically testing the switch.

8. In an inertia switch structure comprising:

a casing that is divided into two chambers by a axially movable wall structure which comprises a diaphragm, mass and terminal operating means;

said terminal operating means being disposed within one of said two chambers;

electrical terminal means which is disposed in said one chamber in the path of said terminal operating means as said diaphragm moves toward said one chamber and which gives a switch signal when operated by said terminal operating means;

orifice means in said wall communicating said two chambers with each other, said orifice means comprising a control orifice;

said inertia switch occupying an off state, when subjected to axial force below a predetermined magnitude and duration characteristic in a sense urging said terminal operating means, mass, and diaphragm toward said electrical terminal means, said off state being defined by said terminal operating means being spaced from said terminal means;

said inertia switch assuming an on state, when subjected to axial force in said sense equaling or exceeding said predetermined magnitude and duration characteristic, said on state being defined by said terminal operating means being placed in contact with said terminal means;

said orifice means functioning to conduct a gas from said one chamber to the other of said chambers in response to displacement of said terminal operating means, mass, and diaphragm toward said terminal means, said control orifice restricting the flow of gas through said orifice means to impart dampening to the motion of said diaphragm, mass, and terminal operating means toward said terminal means;

the improvement which comprises:

means communicating said one chamber to a source of switched vacuum for causing pressure differential to be created across said diaphragm such that said terminal operating means is caused to operate said electrical terminal means when the switched vacuum source applies vacuum to said one chamber, whereby the switched vacuum source can be used to test the inertia switch.

9. In an inertia switch structure comprising:

a casing that is divided into two chambers by a axially movable wall structure which comprises a diaphragm, mass and terminal operating means;

said terminal operating means being disposed within one of said two chambers;

electrical terminal means which is disposed in said one chamber in the path of said terminal operating means as said diaphragm moves toward said one chamber and which gives a switch signal when operated by said terminal operating means;

orifice means in said wall structure communicating said two chambers with each other, said orifice means comprising a control orifice;

said inertia switch occupying an off state, when subjected to axial force below a predetermined magnitude and duration characteristic in a sense urging said terminal operating means mass, and diaphragm toward said electrical terminal means, said off state being defined by said terminal operating means being spaced from said terminal means;

said inertia switch assuming an on state, when subjected to axial force in said sense equaling or exceeding said predetermined magnitude and duration characteristic, said on state being defined by said terminal operating means being placed in contact with said terminal means;

said orifice means functioning to conduct a gas from said one chamber to the other of said chambers in response to displacement of said terminal operating means, mass, and diaphragm toward said terminal means, said control orifice restricting the flow of gas through said orifice means to impart dampening to the motion of said diaphragm, mass, and terminal operating means toward said terminal means;

the improvement which comprises:

said diaphragm comprising a webbed support which is covered by a material which is impermeable to the gas in said one chamber.

* * * * *